United States Patent [19]

Lynn et al.

[11] Patent Number: 4,926,515

[45] Date of Patent: May 22, 1990

[54] IMPROVED MOPPING SYSTEM

[76] Inventors: William R. Lynn, 38 Prospect Street Dover, N.H. 03820; Roger R. Belanger, 336 Back Road Dover, N.H. 03820

[21] Appl. No.: 21,339

[22] Filed: Mar. 3, 1987

[51] Int. Cl.[5] ..... A47L 11/14

[52] U.S. Cl. ..... 15/4; 15/98; 15/99; 15/257.3; 15/257.4; 15/257.6; 401/138; 401/140; 401/196; 401/207

[58] Field of Search ..... 15/50 R, 51, 98, 99, 15/147 R, 228, 229 R, 4; 401/138, 140, 196, 207, 43–47, 136

[56] References Cited

U.S. PATENT DOCUMENTS

| | | | |
|---|---|---|---|
| 2,187,671 | 1/1940 | Suddarth | 401/140 |
| 2,953,798 | 9/1960 | Borie, Jr. | 15/99 |
| 3,820,905 | 6/1974 | Sims | 401/140 |
| 3,945,078 | 3/1976 | Acquaro | 15/99 |
| 4,119,386 | 10/1978 | Cushing | 401/138 |

*Primary Examiner*—Edward L. Roberts

*Attorney, Agent, or Firm*—Davis, Bujold & Streck

[57] ABSTRACT

An improved mopping system useful in cleaning a surface, the mopping system includes in combination a handle having a mop head at one end thereof, a container attached to the handle and holding a dispensable liquid, a valve mechanism for dispensing liquid from the container to a surface, a rotatable absorbent belt for removing liquid from the surface, a scrubber for scrubbing the surface, pressure bar for removing liquid from the absorbent belt and a reservoir associated with the rotatable absorbent belt for storing dirty liquid removed from the floor surface in a container separate from the container carrying the dispensable liquid.

6 Claims, 4 Drawing Sheets

IMPROVED MOPPING SYSTEM

The present invention relates to an improved mopping system allowing for quick and efficient cleaning of a relatively smooth floor surface using a minimal amount of water and detergent so as to leave a relatively dry floor surface, and also allowing for means to pick up bulky objects from a floor surface along with normal dirt and liquids.

THE PRIOR ART

Mopping systems incorporating the use of water and detergent are well known. A typical mopping system would include a mop with either a loose cloth head ("rag mop") or a sponge head attached to the end of a long metal or wooden pole used in conjunction with a water bucket which may include a squeezing mechanism to assist in squeezing dirty water out of the mop head. Other mops have mechanisms attached directly to the mop head which provide means for squeezing the dirty water out of the rag mop or sponge head of the mop. Other more sophisticated mopping system, sometimes referred to as cleaning machines, incorporate the use of electric motors to power components such as rotating brushes which are trailed by vacuum suction devices that provide means for picking up dirty water which has been produced by the rotating brushes scrubbing up dirt with water provided by the machine.

The primary problem with prior art mopping systems and techniques is the inefficient use of water and detergent relative to the amount of floor space cleaned. Also, rag mop systems and mops with sponge heads rinse themselves in their own dirty water. The filth of the water bucket's rinse water is cumulative with each rinse cycle. This results in spreading dirty water around the floor so that the water dries and leaves much of the original dirt on the floor. This effect is compounded unless the water in the bucket is changed frequently.

In addition, prior art mopping systems often leave the cleaned surface in a wet condition for some period of time which is longer than desired. While the cleaned floor surface is wet, there always exists the possibility that someone could slip and fall on the wet surface. This results in additional liability problems relative to cleaning floor surfaces.

Finally, prior art systems are generally inadequate to provide means for cleaning up bulky objects normally seen in the types of spills often found, for example, in a fast food restaurant, e.g., a child spills a soft drink filled with ice, along with a hamburger or a hot dog. These types of spills normally require the restaurant to provide an employee to pick up the ice and hot dog or hamburger bun and meat with paper towels, or some similar technique, rather than being able to use any mopping systems already used for other cleaning chores by the restaurant.

OBJECTS OF THE INVENTION

Accordingly, a primary object of the present invention is to provide a mopping system which substantially reduces the problems noted above.

A more specific object is to provide a mopping system which makes efficient use of water and detergent to clean floor surfaces in a minimal amount of time. Also, the mopping system of the present invention never recycles dirty water—it puts down clean water and picks up dirty water, and does not just push the dirty water around.

Another object of this invention is to provide means for cleaning a floor surface in such a fashion so as to leave a relatively dry surface immediately upon completion of the cleaning process.

A further object of this invention is to provide means for efficiently cleaning up bulky objects along with liquids and normal dirt.

SUMMARY OF THE PRESENT INVENTION

The foregoing objects, and other objects which will become apparent as the nature of the invention is better understood, are achieved by providing a mop assembly which comprises a mop assembly, a floor cleaner, and a scoop. The mop assembly and floor cleaner provide means for cleaning the floor surface in a quick and efficient manner by leaving a relatively dry surface upon completion of the cleaning process. The scoop provide means for picking up bulky objects, along with liquids and normal floor dirt.

GENERAL DESCRIPTION OF THE DRAWINGS

For a fuller understanding of the nature and objects of the present invention, reference should be had to the following description taken in connection with the accompanying drawings wherein.

DETAILED DESCRIPTION OF THE DRAWINGS

Figure 1:
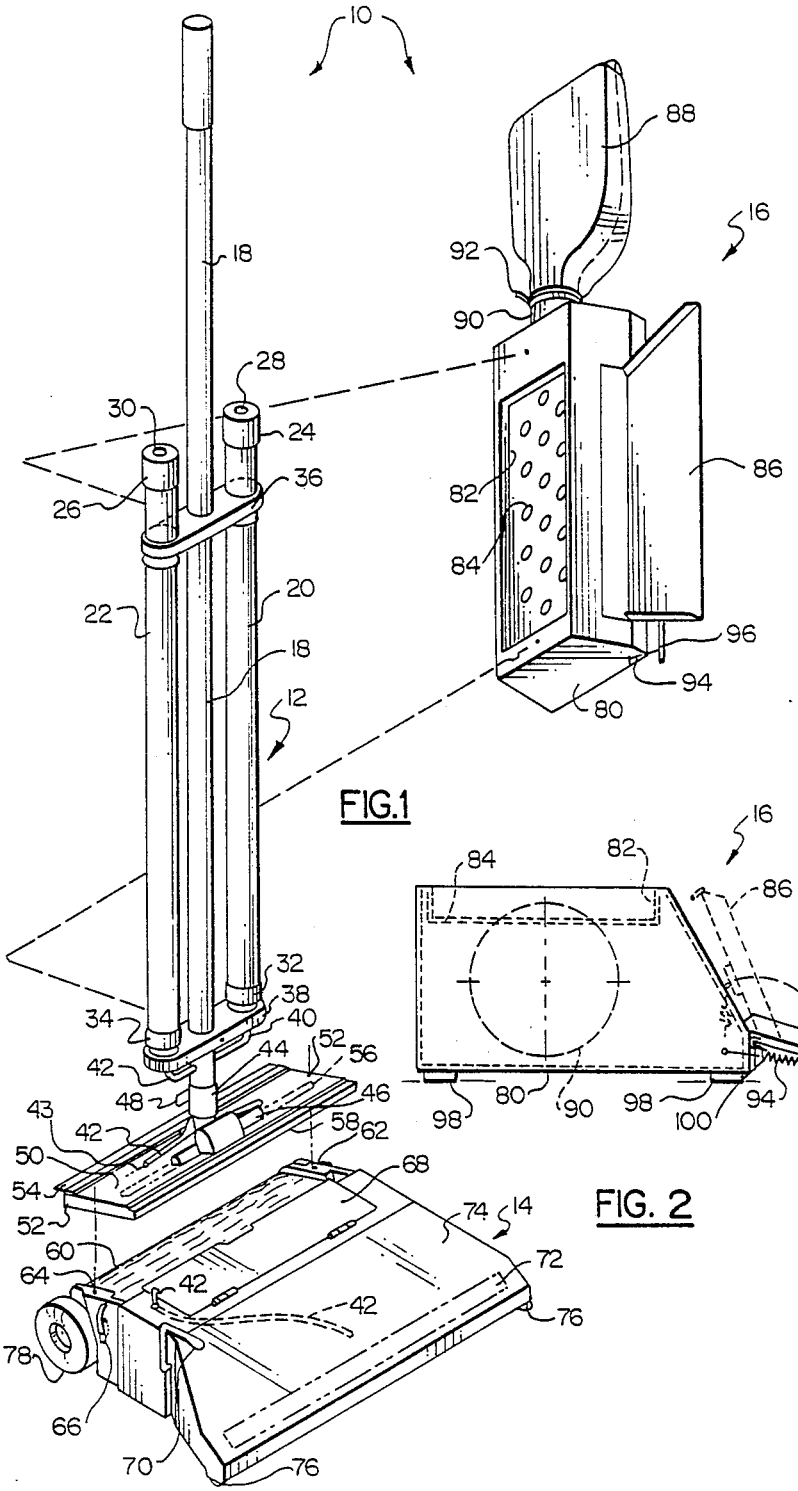
FIG. 1 illustrates a mop assembly of the present invention shown in an exploded view with a floor cleaner portion directly below a mop assembly and a scoop shown at the right side of the mop assembly.

The preferred embodiment of the present invention is shown in FIG. 1 and comprises a mopping system 10 having a mop assembly 12, a floor cleaner 14, and a scoop 16. The mop assembly 12 has a handle 18, a pad flow tube 20, a direct flow tube 22, a grip 24 on tube 20, a grip 26 on tube 22, a check valve 28 in grip 24, a check valve 30 in grip 26, a pad tube flow valve 32 at the lower end of tube 20, a direct tube flow valve 34 at the lower end of tube 22, an upper mount 36 and a lower mount 38 to support tubes 20 and 22, flow tubing 40 and 42 connected to tubes 20 and 22, respectively, a direct tubing connector 43, a neck 44, a pivot joint 46, a handle lock mechanism 48, a mop head plate 50, openings 52 in plate 50, a squeegee surface 54, a distribution tube 56, and a sponge pad 58.

Mop assembly 12 is controlled with the handle 18. Tubes 20 and 22 contain the desired fluids, e.g. water and detergent, and are attached to handle 18 by means of two mounts 36 and 38 which each has an oval shape and three holes sized to snugly hold handle 18 and tubes 20 and 22. Grips 24 and 26 are attached to the upper ends of tube 20 and 22, respectively, and the check valves 28 and 30 are integrally formed in grips 24 and 26, respectively. Grips 24 and 26 are removeable to allow tubes 20 and 22 to be filled through their top ends. The lower ends of tubes 20 and 22 house two flow valves 32 and 34, respectively, which penetrate lower mount 38. The lower end of handle 18 passes through lower mount 38 and connects to neck 44 which is attached to plate 50 by means of pivot joint 46. Flow tubing 40 and 42 are connected to the discharge side of valve 32 and 34, respectively.

Tubing 40 connects pad flow tube 20 to distribution tube 56, and tubing 42 provides a flow path between tube 22 and the forward portion of the floor cleaner 14 when direct tubing connector 43 is utilized to connect the two portions of tubing 42 shown in FIG. 1. Squeegee surface 54 is attached to the rear edge of the plate 50, and sponge pad 58 is attached to the bottom surface of plate 50.

The floor cleaner 14 comprises a cleaning belt 60, two position pins 62 and 64, two fastening clips 66, a housing door 68, an operational mode lever 70, a loading weight 72, a housing 74, two transport wheels 76, and two ratcheted rear wheels 78.

Cleaning belt 60 is held in place by internal components of cleaner 14 which are described in detail below in the descriptions of FIGS. 3–5. Position pins 62 and 64 mate with openings 52 to align and help hold plate 50 to cleaner 14. Fastening clips 66 clip onto plate 50 to ensure that plate 50 and cleaner 14 are tightly connected. Housing door 68 provides access to a water collection reservoir 102 described more fully below. Lever 70 provides for two modes of operation for cleaner 14, as described in detail below in conjunction with FIG. 5.

Loading weight 72 is attached to the forward underside of housing 74 to provide a downward force on the forward edge of housing 74. A portion of tubing 42 is also attached to the underside of housing 74. Transport wheels 76 are mounted to the forward side edges of housing 74. Ratcheted rear wheels 78 are connected to the back of cleaner 14 adjacent to cleaning belt 60.

Scoop 16 comprises a scoop container 80, a recessed area 82 in the top of container 80, openings 84 in recessed area 82, a scoop ramp 86, a collection bag 88, a collection bag neck 90, a bag fastener 92, a ramp spring 94, a ramp lever bar 96, scoop gripping feet 98, and a ramp pivot connection 100.

Figure 2:
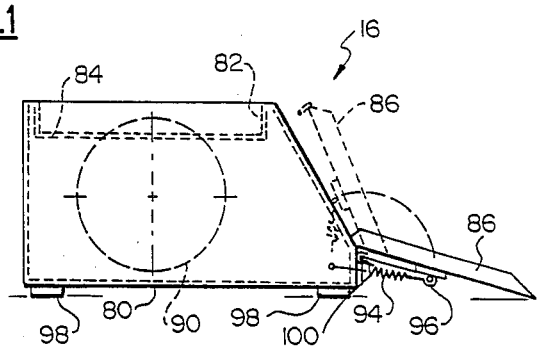
FIG. 2 is a side view in elevation of the scoop shown in FIG. 1.

Turning now to FIG. 2, scoop 16 is depicted in side elevation in order to illustrate the relative positions of ramp 86, container 80, and collection bag neck 90. The motion of ramp 86 is also illustrated, with solid lines showing the down position of ramp 86 when the user is prepared to scoop material into container 80, and phantom lines depicting the closed position of ramp 86 when it is stored on mop assembly 12 adjacent to tubes 20 and 22. To get from one position to the other, ramp 86 pivots around connection 100 while it also pivots on bar 96 to maintain appropriate separation between ramp 86 and container 80. The recessed area 82 is sized to receive mop head plate 50 so that the sponge pad 58 can be squeezed to release dirty fluids into container 80 through openings 84. Liquids and solids scooped into container 80 via ramp 86 or through openings 84 are transferred into the collection bag 88 by lifting scoop container 80 from the end opposite the collection bag 88 so that the waste materials in container 80 pass downward by gravity through neck 90 into bag 88, which is connected to neck 90 with a fastener 92, such as a strip of adhesive tape or a nylon loop which tightens by pulling on one end.

Figure 3:
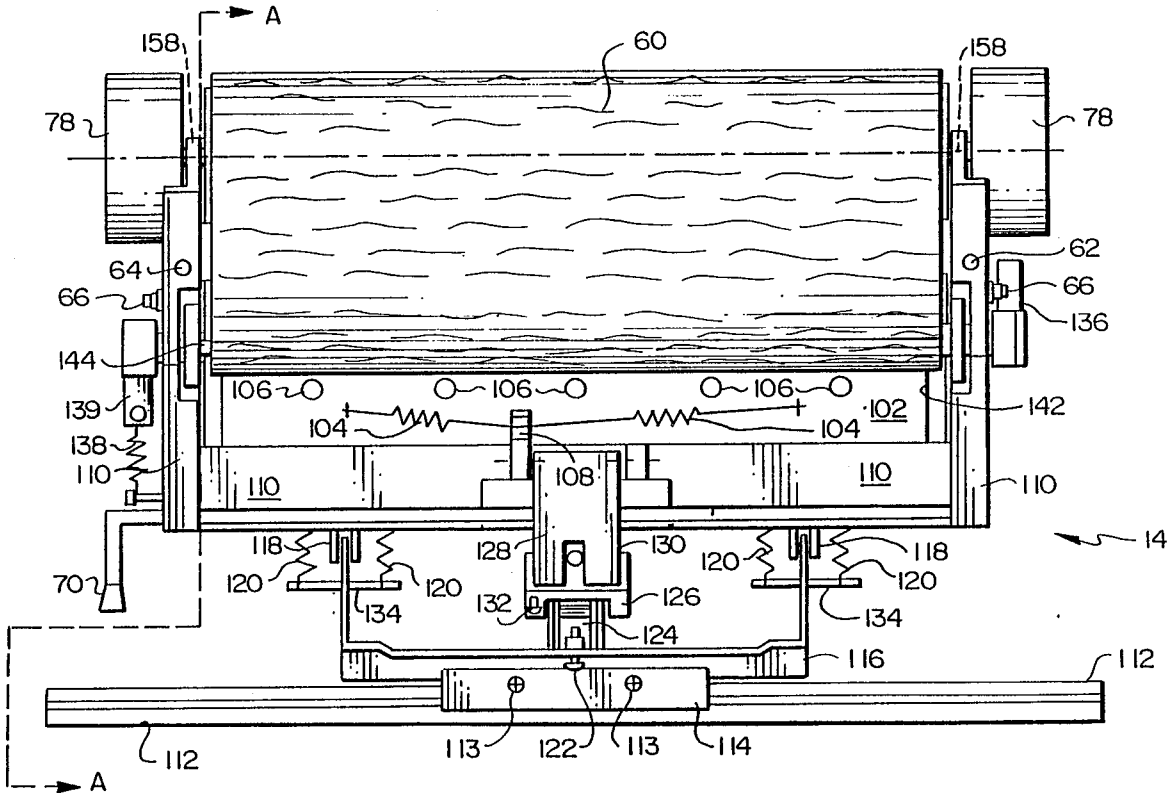
FIG. 3 is a top view of the floor cleaner shown in FIG. 1 with the cleaner housing removed.
Figure 4:
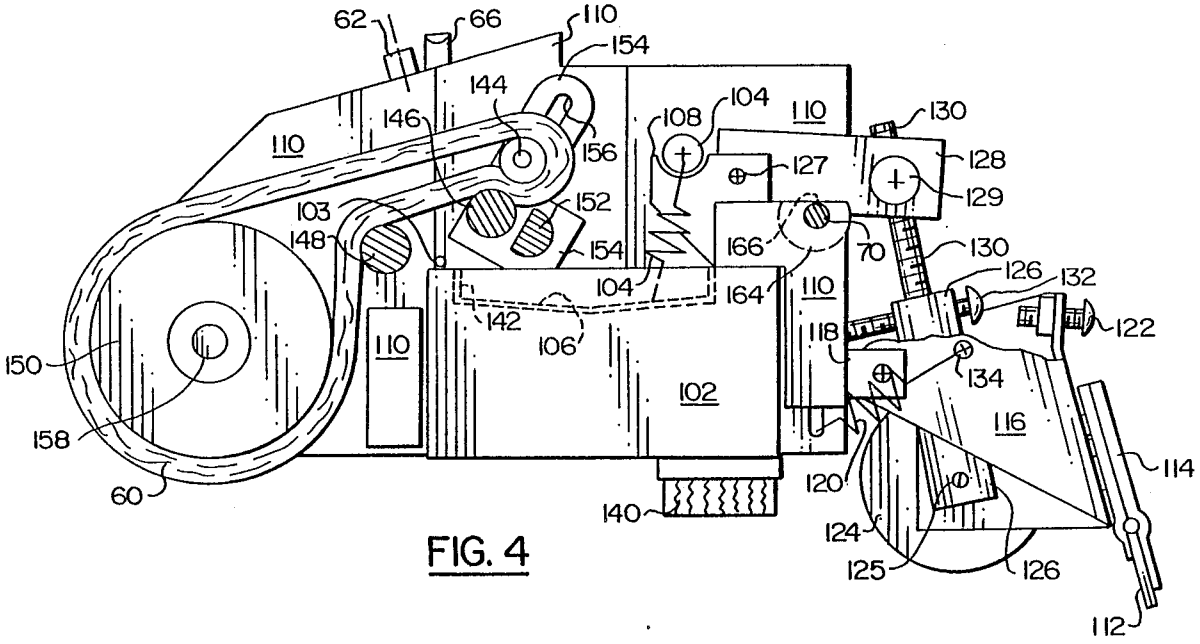
FIG. 4 is a side sectional view of the floor cleaner taken along lines A—A in FIG. 3, with a fragmentary view of an attached squeegee pivot plate.

Turning to FIGS. 3 and 4, the floor cleaner 14 can be seen in much greater detail. Cleaner 14 comprises a waste water collection reservoir 102, a reservoir stop 103, a reservoir connector spring 104, openings 106 in the top of reservoir 102, a spring holder 108 which is attached to a cleaner body 110, a squeegee blade 112, fasteners 113, a blade holder 114, a squeegee pivot plate 116, two squeegee pivots 118, four squeegee pivot springs 120, a front stop 122, a squeegee wheel 124, a wheel housing connector pin 125, a wheel housing 126, a linkage pivot 127, a wheel pivot member 128, a wheel pivot bar 129, a wheel pivot connector pin 130, a rear stop 132, two spring connector bars 134, a belt removal lever 136, a belt tension spring 138, a belt removal spring connector 139, a scrubber 140, and a recessed area 142 in the top of reservoir 102.

The rear portion of cleaner 14 which drives cleaning belt 60 (shown in sectional view in FIG. 4) comprises a floating tension bar 144, a squeeze bar 146, a support bar 148, a drive roller 150, a belt removal lever bar 152, a support fitting 154 with an oval slot 156 formed in it, a rear wheel/drive roller axle 158, a clearance opening 160, two notches 162, and a squeegee cam 164 with a flat surface 166.

A detailed description of the operation of the mopping system 10 of the present invention follows. Looking first at FIG. 4, cleaning belt 60 can be seen in sectional view relative to the various components which hold it in place and ensure proper functioning of belt 60. When the floor cleaner 14 is pushed across a floor surface to be cleaned (not shown), belt 60 is caused to move. More specifically, when cleaner 14 in FIG. 4 is pushed to the right (forward movement), belt 60 is caused to move, by the friction between the floor and ratcheted real wheels 78 and belt 60, in a generally clockwise direction. As belt 60 comes in contact with the floor surface, dirty water is absorbed from the floor. Water is first applied to the floor surface via direct flow tube 22 and direct flow tubing 42 (see FIG. 1). Cleaning belt 60 is made of a rectangular piece of absorbent material which is connected at the ends having the smaller dimensions to form an "endless" belt which moves around bar 144 and roller 150. After belt 60 absorbs the dirty water from the floor, it continues its clockwise movement until it comes in contact with the floating tension bar 144, which moves freely in oval slot 156 that is formed in support fitting 154. Bar 144 maintains proper tension on belt 60 by means of belt tension spring 138 pulling on spring connector 139 to ensure that the belt makes enough frictional contact with roller 150 (in addition to the floor surface) to move in a clockwise direction when floor cleaner 14 is pushed in a forward direction. Bar 144 also compresses belt 60, in conjunction with squeeze bar 146, with enough force to adequately squeeze the dirty water from belt 60 into the waste water collection reservoir 102 via openings 106 (FIG. 3) in recessed area 142. It is important to note, however, that the squeezing pressure between bar 144 and bar 146 is not so great as to impede smooth clockwise motion of the cleaning belt 60 around bar 144 and over support bar 148. Slight upward movement of bar 144 in slot 156 relieves enough of the squeezing pressure to allow relatively easy movement of belt 60, while still squeezing out an adequate amount of dirty water from the belt.

The cleaning belt 60 can be removed easily from cleaner 14 and subsequently replaced by operation of the belt removal lever 136 (see FIG. 3). Turning now to FIG. 5, in order to remove belt 60 from cleaner 14, spring connector 139 and belt removal lever bar 152 are rotated in a counterclockwise direction by clockwise rotation of lever 136 (not shown) on the opposite side of cleaner 14. Since fitting 154 rotates about bar 152, this movement of bar 152 causes counterclockwise rotation of fitting 154 about bar 152. This movement, in turn causes tension bar 144 to approach the stationary support bar 148, thereby removing any tension on belt 60. This movement of bar 144 also aligns the bar 144 with clearance opening 160. This allows bar 144 to be moved laterally toward spring connector 139 enough to disengage bar 144 from fitting 154. Once bar 144 is freed from fitting 154 and opening 160, the cleaning belt 60 can be removed from cleaner 14 by dropping axle 158 out of the two notches 162 in body 110 adjacent to ratcheted rear wheels 78 (see FIGS. 3 and 5).

A detailed description of the operation of the front end of floor cleaner 14, including squeegee blade 112, follows. There are two basic modes of operation relative to squeegee blade 112. Either of the two modes is selected with the operational mode lever 70. The two modes are illustrated in FIG. 5—lever 70 is shown in solid lines in the "OFF" position, and lever 70 is drawn in phantom for the "ON" position.

Figure 5:
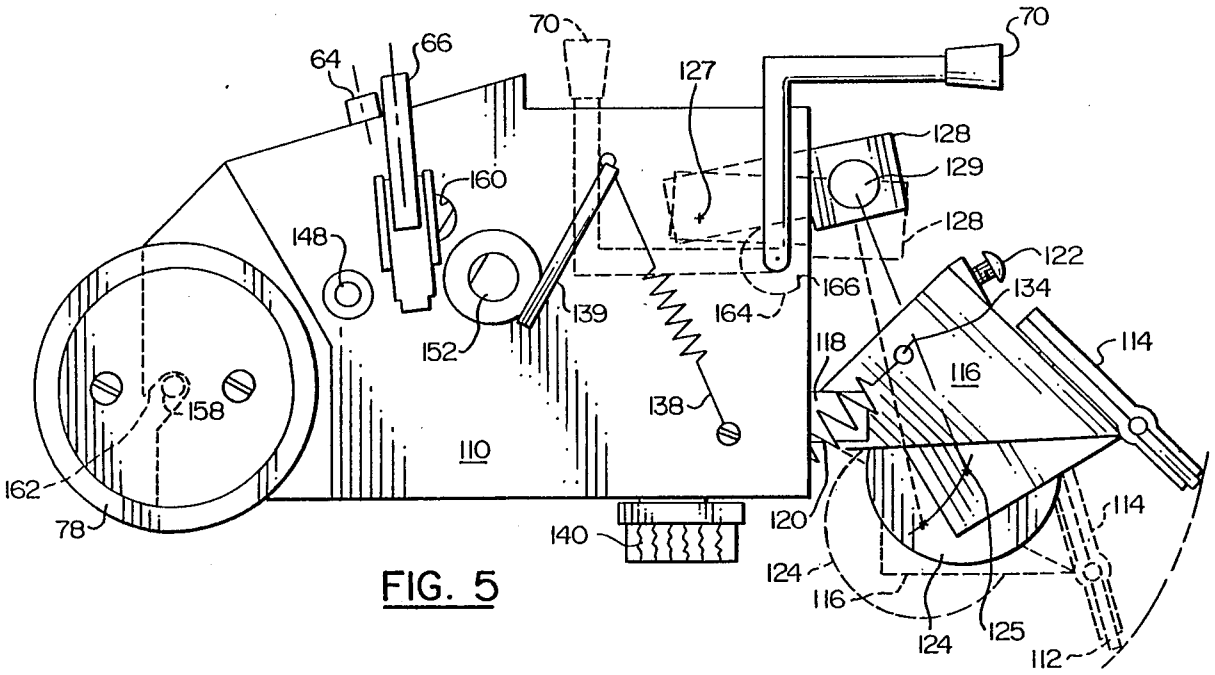
FIG. 5 is a side view of the floor cleaner shown in FIG. 3, with a phantom view of a squeegee blade and associated parts to assist in illustrating movement of the squeegee mechanism of the floor cleaner in its different operational modes.

When lever 70 is in the "OFF" position, a squeegee cam 164 is rotated to the position shown in FIG. 5 so as to lock wheel pivot member 128, which pivots about linkage pivot 127, in its upper position, as shown in solid lines in FIG. 5. This motion in turn causes squeegee pivot plate 116 to rotate counterclockwise as shown in FIGS. 4 and 5 about squeegee pivots 118. Squeegee pivot plate 116 travel is limited by contact between front stop 122 and wheel housing 126 (see FIG. 4) in the "OFF" position. When the floor cleaner 14 is in this "OFF" position, only ratcheted rear wheels 78, cleaning belt 60, scrubber 140, and squeegee wheel 124 make contact with the floor surface. This position is used at the beginning of the floor cleaning process. An operator (not shown) of the mopping system 10 would typically use the mop assembly 12 and the floor cleaner 14 together, attached to each other with position pins 62 and 64 mated with openings 52 (FIG. 1) and clips 66 fastened over plate 50, with scoop 16 in its stored position snug against the rear side of tubes 20 and 22. With lever 70 in the "OFF" position, as described above, liquid is released by the operator from either tube 20 or tube 22, or both, depending on whether cleaning belt 60 is damp or dry. If belt 60 is still damp from its last use, the operator would normally release water or some other liquid desired (e.g., a water/detergent solution) from direct flow tube 22. This liquid discharge is accomplished by the operator pushing grip 26 downward so as to open direct tube flow valve 34. The liquid flows from tube 22 through valve 34 into direct tube flow tubing 42. The portion of tubing 42 attached to mop assembly 12 is connected to the portion of tubing 42 attached to floor cleaner 14 via a direct tubing connector 43. This tubing 42 connection is normally made whenever mop assembly 12 and floor cleaner 14 are attached to each other. Tubing 42 transfers the liquid from tube 22 to the forward edge of cleaner 14 via gravity feed, and check valve 30 admits air to displace the released liquid. Tubing 42 releases the liquid directly onto the floor surface to be cleaned, just in front of cleaning belt 60 and scrubber 140. The operator can either discharge a desired amount of liquid from tube 22 by pushing downward on grip 26 until the desired amount of liquid has been released and then removing any force on grip 26 to allow the spring-loaded flow valve 34 to return to its closed position, or the operator can push down on grip 26 and rotate tube 22 so as to lock valve 34 in its open position to provide continuous discharge of liquid from tube 22. The operator can later rotate tube 22 back to its original position so as to allow spring-loaded flow valve 34 to return to its closed position.

If cleaning belt 60 has dried since its last use, then the operator will normally discharge water, or some other desired liquid, from pad flow tube 20 in the exact same manner as described above for tube 22. The liquid can either be released in one burst by pushing downward on grip 24, or the operator can push downward and rotate tube 20 to lock the spring-loaded flow valve 32 in its open position. When valve 32 is open, liquid drains by gravity from tube 20 through valve 32 and pad tube flow tubing 40 into distribution tube 56 attached to the bottom side of mop head plate 50. The liquid flows down onto the upper portion of belt 60, and the liquid discharged from tube 20 is displaced by air admitted through check valve 28. Since sponge pad 58 is removed from the bottom of plate 50 when mop assembly 12 and floor cleaner 14 are attached and used together, pad 58 does not interfere with the flow of liquid from distribution tube 56 to the top of cleaning belt 60. Since operational mode lever 70 is still in the "OFF" position, liquid discharged onto the floor surface to be cleaned via tubing 42 is utilized to wet the dirty floor surface so that scrubber 140 and belt 60 can loosen up the dirt/water combination and scrub stubborn areas where the dirt may be stuck to the floor surface to a greater than normal degree. Once liquid has been spread around on the surface to be cleaned, and cleaning belt 60 has been adequately moistened, the operator will normally shift the operational mode lever 70 to the "ON" position.

When lever 70 is in the "ON" position, as shown in phantom lines in FIG. 5, the squeegee cam 164 is positioned so that its flat surface 166 faces upward, flush with the bottom surface of wheel pivot member 128, as shown in FIG. 4. This camming action allows member 128 to rotate clockwise, as shown in FIG. 5, about linkage pivot 127.

This rotation of member 128, caused by tension from the four squeegee pivot springs 120, coincides with clockwise rotation of squeegee pivot plate 116 about the two squeegee pivots 118. Rotation of member 128 and plate 116 is limited by contact between the rear stop 132 and cleaner body 110, as shown in FIG. 4. When stop 132 is in contact with body 110, the squeegee blade 112 is in its lowest possible position. When the operator operates mop assembly 12 and floor cleaner 14 together in the forward direction (to the right in FIGS. 4 and 5) with lever 70 in the "ON" position, handle 18 is normally pushed downward hard enough to cause member 128 to pivot up to the same position described when lever 70 is in the "OFF" position. This movement coincides with squeegee blade 112 pivoting up away from the floor, so that scrubber 140 scrubs the floor and cleaning belt 60 picks up the dirty liquid from the floor. Belt 60 moves clockwise, as shown in FIG. 4, and releases the dirty liquid into reservoir 102 when squeezed between bar 144 and 146, as described above. When reservoir 102 becomes full of dirty liquid, the operator can remove and empty the reservoir by pulling connector spring 104 upward and back, away from spring holder 108, so as to allow reservoir 102 to be removed from the bottom of cleaner 14. After the reservoir has been emptied, the operator reinserts reservoir 102 back into its original position, where its upward movement is limited by reservoir stop 103 (see FIG. 4). Spring 104 is then pulled up and onto holder 108 to lock reservoir 102 into its ready position. When the operator subsequently pulls cleaner 14 backwards (to the left in FIGS. 4 and 5) with handle 18, the downward force on handle 18 is released so as to cause member 128 and squeegee blade 112 to pivot downward to their lowest positions, as shown in FIG. 4. In this position, cleaner 14 contacts the floor with only the ratcheted rear wheels 78 and squeegee blade 112. As the operator pulls cleaner 14 backward, the squeegee blade 112 scrapes (with the help of force from loading weight 72) any liquids from the floor surface so as to leave the surface relatively dry. The flatter and smoother the surface, the drier the squeegee blade 112 will tend to leave the surface. It should also be noted that when cleaner 14 is pulled backward, ratcheted rear wheels 78 continue to rotate normally, but the drive roller 150 and belt 60 are stationary due to the ratchet function of wheels 78.

This operational action of scrubbing the floor and picking up water in the forward direction and squeegeeing the floor in the reverse direction is repeated on every stroke. This action of blade 112 is a major improvement over prior art mopping systems which tend to leave a very wet floor surface which can take many minutes to dry via evaporation. The owner of the building containing the just-cleaned floor is less vulnerable to potential personal injury lawsuits caused by a customer, employee, or client slipping on a wet floor when the floor is cleaned with the mopping system 10 of the present invention.

When mop assembly 12 and 14 are used together, the floor cleaner 14 may be prevented from cleaning under certain objects due to height constraints; in this event, the mop assembly 12 would be detached from assembly 14 and used in the manner described below.

Mop assembly 12 has a sponge pad 58, which would be attached to the bottom of plate 50, e.g. by the use of Velcro TM, and a squeegee surface 54, similar to squeegee blade 112, on the rear edge of mop head plate 50. To clean up an ordinary dirty dry floor surface, the operator would first wet the floor surface via tube 22 and tubing 42 (now disconnected at connector 43) in a manner similar to that described above. Pad 58 may be moistened before the cleaning process is begun in a manner similar to that described above for moistening belt 60, i.e., liquid is released from pad flow tube 20, by pushing down on grip 24, through flow valve 32 and tubing 40 into distribution tube 56. The liquid then gravity drains from tube 56 onto the top of sponge pad 58 until pad 58 is adequately moistened. Now that the floor is adequately moistened, along with sponge pad 58, assembly 12 can be used to get into the hard-to-reach areas. By unlocking lock mechanism 48, handle 18 can be rotated downward, parallel to plate 50, thus giving it a low profile. Sponge pad 58 can now access very low areas, e.g., under desks, etc., which often get neglected with conventional mops, and squeegee surface 54 can be used to pull out dirt and large bulky objects where the floor meets the wall, again leaving the floor relatively dry as soon as the cleaning operation is completed.

Mop assembly 12 can also be used by the operator in conjunction with scoop 16 when it is necessary to clean up a floor surface with bulky objects, in addition to ordinary dirt and liquids. Scoop 16 must first be removed from its stored position at the rear of tubes 20 and 22. The operator then can use mop assembly 12, in the same manner as described above for use of assembly 12 by itself, to clean up any liquids and ordinary dirt. Scoop 16 can then be used to help clean up any bulky objects. A common example of when the scoop 16 would be required is when someone at a fast food restaurant, who is holding a tray containing a soft drink with ice and a hamburger, spills it. The liquid and ice from the soft drink, along with the hamburger bun and meat patty, could be cleaned up easily using the scoop 16 in the following manner. The restaurant employee, hereinater called the operator, would place container 80 on the floor next to the liquid, ice and hamburger. Container 80 would be supported by gripping feet 98, which tend to prevent container 80 from slipping around on the floor. Scoop ramp 86 would be in its stored position, as shown in phantom in FIG. 2, so the operator would pull ramp 86 downward to the position shown in solid lines in FIG. 2. The operator could then use squeegee surface 54 to scrape the liquid, ice and hamburger from the floor, up ramp 86, and into the interior of container 80. The operator can then use sponge pad 58 again to further clean the floor. Pad 58 can be rinsed by positioning the pad and plate 50 in recessed area 82 and pressing down to release dirty liquid into container 80 via opening 84. The operator then tilts container 80 until collection bag 88 is directly beneath container 80. This would allow gravity to force the liquids, ice, and hamburger to fall through neck 90 into bag 88, or some other collection system. The operator could then loosen fastener 92 and separate bag 88 from neck 90. The open end of bag 88 could then be sealed shut with fastener 92 to allow temporary or permanent disposal of bag 88.

Handle 18 can be pivoted through an arc of approximately ninety degrees about pivot joint 46, from almost parallel to the floor to a vertical position perpendicular to the floor. Handle lock mechanism 48 locks handle 18 in the vertical position when transporting mop assembly 12 and cleaner 14 from the storage site to the floor area to be cleaned; for example, the operator would normally tilt handle 18 forward until most of the weight is supported by transport wheels 76—the operator would then roll the assembly 12 and cleaner 14 (with lever 70 in the "OFF" position) around on transport wheels 76 as far as desired. greatly facilitate movement of the cleaner 14 along the floor surface, especially when used on a large-scale model of the present invention.

Another possible modification relates to the scoop 16, used in conjunction with mop assembly 12. Wheels could be added to the side of container 80 opposite ramp 86, and fastening clips could be added to the top of container 80 to hold mop assembly 12 to container 80 with plate 50 mated in recessed area 82. This modification would allow mop assembly 12 and scoop 16 to be rolled around and used together as an emergency spill kit.

Another alternative configuration of the scoop 16 would be to have the recessed area 82 in the top of container 80 hinged to allow access into the interior of container 80. This modification would allow a more thorough cleaning of the container if it were heavily soiled.

Another possible modification of scoop 16 would be to have collection bag neck 90 configured so as to allow other collection mediums to be used, such as a plastic bottle fastened to neck 90 with a threaded screw-on connection.

Another possible modification of the mopping system would be a cleaning belt 60 that had been perforated with multiple holes.

Another possible modification would be to actuate squeegee blade 112 by different means, such as an electric solenoid with batteries attached to handle 18, or a pneumatic actuator. These alternative actuators could be controlled by a sensor which would operate when the mode lever 70 is in the "ON" position and would sense ratcheted rear wheels 78 moving in the reverse direction to actuate squeegee blade 112 to its down position, in contract with the floor surface.

Since certain changes may be made in the above apparatus without departing from the scope of the invention herein involved, it is intended that all matter contained in the above description or shown in the accompanying drawings shall be interpreted as illustrative and not in a limiting sense.

What is claimed is:

1. An improved mopping system for use in cleaning a surface comprising in combination:

a mopping assembly comprising handle means;

means for containing a dispensable liquid;

a floor cleaner apparatus having a top surface, and, a bottom surface positioned adjacent which, for contacting the surface to be cleaned, is a rotatable means for absorbing liquid from the surface to be cleaned; said rotatable absorbent means having means for removing liquid therefrom which has been absorbed from the surface to be cleaned and reservoir means, separate from the container means, associated with said removing means, for storing liquid removed from said rotatable absorbent means;

means for attaching said container means to said mopping system;

means for dispensing fresh liquid from the container means onto the surface to be cleaned; and means for fastening said handle means to the top surface of the floor cleaner apparatus.

2. An improved mopping system according to claim 1, wherein said floor cleaner apparatus further comprises, adjacent the bottom surface thereof, means for scrubbing of the surface to which liquid has been applied.

3. An improved mopping system according to claim 2, wherein said floor cleaner apparatus further comprises, adjacent the bottom surface thereof, means for squeegeeing liquid from the surface to be cleaned.

4. An improved mopping system according to claim 3, wherein said rotatable absorbent means is an absorbent endless belt.

5. An improved mopping system according to claim 4, wherein said removing means is a pressure means for applying pressure to said absorbent endless belt and squeezing liquid therefrom.

6. An improved mopping system according to claim 1, wherein said handle means is releasably fastened to the floor cleaner apparatus.

* * * * *